United States Patent [19]

Würfel

[11] 4,421,632

[45] Dec. 20, 1983

[54] PROCESS FOR HYDROGENATION OF COAL

[76] Inventor: Helmut Würfel, Zur Wolfsfels 21, 6685 Blieskastel, Fed. Rep. of Germany

[21] Appl. No.: 183,797

[22] Filed: Sep. 4, 1980

[51] Int. Cl.[3] ..... C10G 1/06

[52] U.S. Cl. ..... 208/10

[58] Field of Search ..... 208/10

[56] References Cited

U.S. PATENT DOCUMENTS

| | | | |
|---|---|---|---|
| 2,676,908 | 4/1954 | Novel | 208/10 X |
| 3,652,446 | 3/1972 | Dengler et al. | 208/10 |
| 4,189,374 | 2/1980 | Kirby et al. | 208/8 LE |
| 4,222,844 | 9/1980 | Nizanoff | 208/10 X |

FOREIGN PATENT DOCUMENTS

| | | | |
|---|---|---|---|
| 2651253 | 11/1978 | Fed. Rep. of Germany | 208/10 |

*Primary Examiner*—William G. Wright

*Attorney, Agent, or Firm*—James Creighton Wray

[57] ABSTRACT

Coal is mixed with emulsifier oil to form a slurry. The coal slurry is pumped to reaction pressure, heated and subjected to catalytically accelerated hydrogenation in the presence of hydrogen. At least a portion of hot gases produced during hydrogenation is drawn off from the reactor and is mixed with the coal slurry which has been pumped to the reaction pressure. Direct heat exchange occurs between the hot gases in the coal slurry causing the condensation heat of the hot gases to be released to the coal slurry. The released heat is sufficient to heat dry and at least partially degasify the incoming coal slurry. Gases are separated from the resultant mixture and the remaining slurry is directly communicated to the reactor for hydrogenation. The gas which leaves the slurry mixture gives up heat to incoming hydrogen. A condensate of the gas is distilled and heavy oil is returned to the slurry mixture. Remaining gas is washed in an oil wash facility from which hydrogen free gas is withdrawn and hydrogen is returned to the hydrogen feed. The liquid phase from the reactor is vacuum distilled; a solid residue is removed, and heavy oil is returned to an emulsifier vessel to mix with the incoming coal.

11 Claims, 1 Drawing Figure

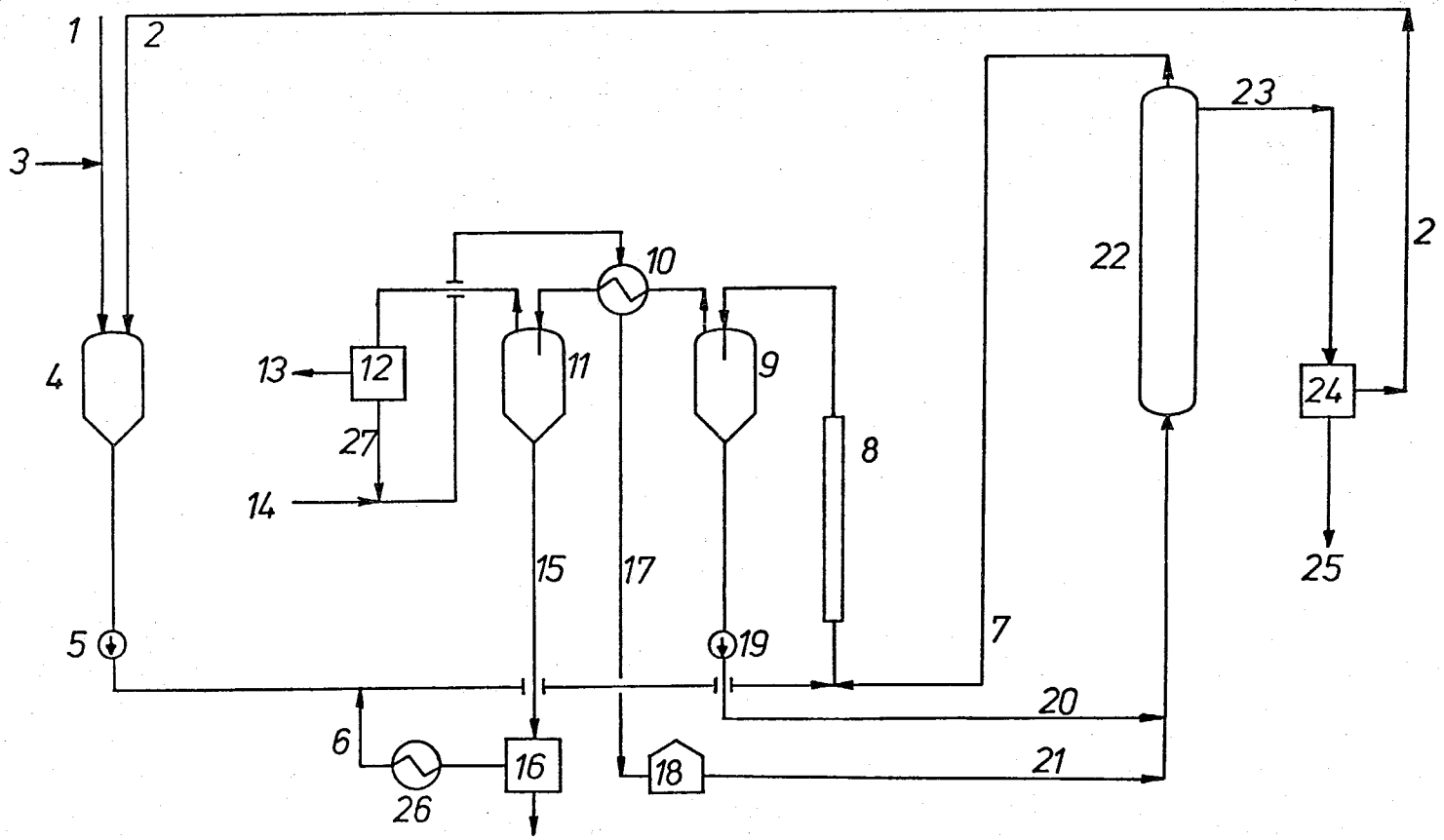
1
2
3
4
5
6
7
8
9
10
11
12
13
14
15
16
17
18
19
20
21
22
23
24
25
26
27

PROCESS FOR HYDROGENATION OF COAL

The invention relates to a process for hydrogenation of coal, in which the coal is mixed with an emulsifier oil to form a slurry. The slurry is pumped to reaction pressure, heated and is then subjected to catalytically accelerated hydrogenation in the presence of hydrogen.

A process for the hydrogenation of coal is known in which the coal is dried and in pulverized form is mixed with emulsifier oil, and the coal slurry obtained is then pumped to reaction pressure, and is heat exchanged with a portion of the subsequent reaction products. The slurry is then heated in a preliminary heater to a temperature close to that of the reaction by bringing in outside heat, and is subsequently hydrogenated in a reactor, in the presence of hydrogen and a suitable catalyst. The product fraction leaving the reactor is fractionated in a subsequent heat exchanger into a vaporous main fraction comprising gases, benzenes, and distillation oils, and a liquid base fraction comprising unreacted coal, ashes, catalyst particles, as well as other high-molecular substances which are difficult to hydrogenize, such as asphaltenes, in particular, as well as bitumen and heavy oil.

While the main fraction is cooled by heat exchange with the coal slurry and is being drawn off by the charge, the heavy oil is separated from the base fraction and is utilized as an emulsifier oil for the incoming coal.

Disadvantages of this known process are its high energy consumption as well as its considerable equipment expense.

Thus the entire coal charge must be dried in a special drier using outside heat. For example, if the charge consists of bituminous coal with an average water content of about 8%, the drying of a ton of coal requires an energy output of about 0.1 Gcal (gram calories). Moreover, the coal has to be pulverized in an expensive process to a particle size of $<0.1$ mm.

In the known process hydrogenation occurs at relatively high pressure, which is due to the fact that in the process of preheating the coal slurry to the hydrogenation start-up temperature of approximately 410° C. gas, separating as physically and chemically bound water and lower hydrocarbons (methane, ethane, etc.) reaches the reactor. This causes a lowering of the partial pressure of the hydrocarbon which only can be compensated for by increased total pressure in the reactor resulting in turn in a requiremnt for increased pump energy and increased equipment expense for reinforcing the reactor and other pressure equipment.

A disadvantage of the known process is that heat exchange for heating the coal slurry has proven to be difficult. As the coal slurry has high viscosity, a uniform introduction of the coal slurry into the areas of the heat exchanger is hard to achieve, and additionally, the further heating of the coal slurry in the preheater presents difficulties since the coal suspended in the slurry greatly expands as a result of the prevailing high temperatures. This results in a further increase in viscosity so that in the end, only a pulsating passage of the coal slurry through the preheater is possible, which causes considerable abrasion and wear to the equipment. In this connection, pressure shocks of up to 10 bar can occur.

The objective of the present invention is directed to a process for the hydrogenation of coal mentioned above, wherein there are improved economics in energy consumption and equipment expense.

The invention achieves this objective in that at least a portion of the hot product gases, resulting from the hydrogenation, are intimately mixed with the coal slurry under pressure, and that the gases can be separated from the resultant mixture of gases, liquids and solids, and the remaining mixture, consisting of solids and liquids, can be hydrogenated.

The intimate mixing of the incoming coal slurry, already pumped to pressure, with the hot gases occurring as a reaction product at the top of the hydrogenation reactor, or at the top of the heat separator—if there is one subsequent to the reactor—greatly enhances heating of the coal slurry. Thereby all of the physically bound, and a portion of the chemically bound water contained in the coal is withdrawn. In the course of this heat exchange, the coal is completely dried, and a significant feature is that the usual costly drying step in the coal preparation process, can be dispensed with.

Another important advantage is that due to the high temperature attained by the coal in direct heat exchange with the hot product gases from the hydrogenation, other gases contained in the coal, like methane, ethane and others, are released. The coal entering the hydrogenation process following heat exchange thus is already essentially free of gas, reducing formation of gases in the hydrogenation reactor itself. This in turn leads to an increased hydrogen partial pressure in the reactor, enhancing hydrogenation effectiveness. In comparison to known processes, hydrogenation can now be carried out at a lower total pressure, thereby making it more economical in both initial investment and operating costs.

The combination of gases, liquids and solids, which result from the intimate mixing of the hot product gases and the coal slurry, is fractionated in a heat separator downstream from the mixing device. The heated base product from the separator, now comprising distillation oils condensed from product gases in addition to the coal slurry, is directly carried to the hydrogenation reactor. The gases formed at the top of the separator are further cooled by the hydrogenation of hydrocarbon. The distillation oils, condensed during cooling, are processed in a distillation facility, while the remaining gases are washed and the hydrocarbon recovered in the process is recycled. Further treatment of the recovered distillation oils can be carried out in a distillation facility without difficulty because all non-distillable components,like entrained asphaltenes, and others, which originally were part of the hot product gases in the hydrogenation reactor, have already been washed out in the process of the direct heat exchange with the coal slurry, and together with the slurry, are returned to the hydrogenation reactor.

Another essential advantage of this process is that the heating of the incoming coal slurry to hydrogenation start-up temperature does not require heat exchangers charged with the coal slurry. The largest portion of the heat required is introduced in the form of exothermic reaction heat in the process of mixing the hot product gases. In a further feature of the invention, additional heat which may be required can be obtained either by heating of the hydrogenation hydrocarbon and/or by mixing the coal slurry with a heated distillation fraction from the destillation plant, mentioned above.

Moreover, the costly pulverizing of the coal to an average size of $<0.1$mm becomes unnecessary as the coal, on its way to the hydrogenation reactor, only passes through pipes, instead of passing through heat exchangers, where it could cause deposits.

A device for carrying out the process is characterized in that the exit of the high-pressure pump for the incoming coal slurry and the top of the hydrogenation reactor are in communication with the inlet of a mixing device, the exit of the mixing device is in communication with a separator, and the bottom of the separator is in communication with the inlet of the hydrogenation reactor.

Further details of the invention are depicted by way of a schematic. The drawing shows schematically a process for the hydrogenation of coal, in which the coal to be processed, without previous drying and having a water contents of about 6% and a particle size of up to 2 mm, is fed to an emulsifier vessel 4 via line 1 and is mixed emulsifier oil which is entering via line 2. The catalysts required for the hydrogenation, e.g. alloys of metals of Groups IV, VI and VIII of the Periodic System, or combinations thereof, are supplied via line 3 and mixed with the coal or sprayed onto it, respectively. In the emulsifier vessel 4, the slurry has a ratio of 70% by weight coal to approximately 30% by weight oil.

The coal slurry is pumped to a pressure of approximately 200 bar by pump 5 and is carried directly to the lower region of mixing device 8. At the same time, mixing device 8 is supplied with hot product gases from the top of hydrogenation reactor 22 via line 7. These gases, which in addition to hydrogen, water vapor and low-boiling hydrocarbons like methane, ethane, etc. essentially contain distillation oils in the naphtha-, medium- and heavy oil range, have a temperature of approximately 470° C. and are intimately mixed with the incoming coal slurry in mixing device 8. Mixing device 8 advantageously consists of a simple, vertical pipe.

Due to the rapid mixing, the temperature at the exit of mixing device 8 is approximately 400° C., which aids in the removal of all water contained in the coal, and even a portion of the chemically bound water, as well as highly volatile gases, like methane, ethane, etc.

The contents of mixing device 8, having been thoroughly mixed, is directed to separator 9, where it is separated into a gaseous and a solids-liquid phase. The solids-liquid phase, now consisting of dried coal and partially degassed coal, in addition to emulsifier oil, heavy oil and entrained asphaltenes from the product gases, which have been condensed and washed out during the mixing process, are now fed directly to hydrogenation reactor 22 by pump 19 via line 20.

The gaseous phase of separator 9 is further cooled and thereby partially condensed in heat exchanger 10, and directed to separator 11. The top product of separator 11 reaches a wash facility 12 and is subjected there to an oil wash. Hydrogen-free residual gas is withdrawn via line 13, while the remaining hydrogen is mixed with fresh hydrogen entering via line 14, is then carried to heat exchanger 10 via line 17, then to furnace 18 for further heating and finally is returned to the hydrogenation reactor via line 21.

The bottom product of separator 11, essentially a fraction consisting of naptha-, medium-, and heavy oil, as well as water, is directed via line 15 to distillation plant 16, where it is separated into the different product fractions.

If additional heat is required for heating of the fresh coal slurry, aheavy oil fraction is extracted from distillation plant 16, heated in a heat exchanger 26 by an outside heat supply and is then added to the incoming coal slurry, via line 6.

The liquid portion of the product occurring in the hydrogenation reactor is directed to vacuum distillation facility 24 via line 23. The heavy oil thus recovered flows in the form of emulsifying oil towards container 4 via line 2, while the solids-containing distillation residue is withdrawn from the facility via line 25. The residue can be further processed in a gasification plant (not depicted) for the production of hydrogen.

I claim:

1. Process for the hydrogenation of coal in which substantially undried coal is mixed with emulsifier oil to form a slurry, the coal slurry is pumped to reaction pressure, heated and subjected to catalytically accelerated hydrogenation in the presence of hydrogen in a hydrogenation reactor, characterized in that at least a portion of the hot product gases occurring in the hydrogenation reactor are separately drawn off from the reactor without cooling and directly communicated for admixture with coal slurry which has been pumped to reaction pressure, direct heat exchange between the hot product gases and the coal slurry causing the condensation heat of said hot product gases to be released to the coal slurry, said released heat being sufficient to heat, dry and at least partially degasify the coal slurry, and that the gases are separated from the resultant mixture consisting of gases, liquids and solids, and that the remaining product consisting of solids and liquids are directly communicated to the reactor for hydrogenation.

2. Process according to claim 1, characterized in that the separated gases are further cooled in heat exchange with hydrogenation hydrocarbon.

3. Process according to claims 1 or 2, characterized in that the hydrogen required for the hydrogenation is heated by an outside heat supply before introduction into the hydrogenation reactor.

4. Process according to one of claims 1–3, characterized in that the hydrocarbons condensed during cooling of the gases are separated, distilled, and that at least a portion of the heavy oil recovered in the distillation is heated and added to the incoming coal slurry, already pumped to pressure.

5. Process according to claim 1, characterized in that the direct heat exchange is sufficient to substantially completely dry the coal slurry.

6. Process according to claim 1, characterized in that the direct heat exchange is sufficient to heat the slurry to substantially process temperature.

7. Process according to claim 1, wherein the direct heat exchange is sufficient to release lower hydrocarbons from the coal, said lower hydrocarbons being separated from said resultant mixture prior to hydrogenation of said remaining products.

8. Process according to claim 1, wherein, said hot product gases occur as reaction product at the top of the hydrogenation reactor.

9. Process according to claim 1, wherein the coal slurry comprises previously undried coal having a water content of up to about 6%.

10. Process according to claim 1, wherein the coal slurry comprises coal having a particle size of up to about 2 millimeters.

11. Process according to claim 1, wherein said remaining product comprises dried coal and partially degassed coal.

* * * * *